US005789135A

United States Patent [19]

Katoh et al.

[11] Patent Number: 5,789,135

[45] Date of Patent: Aug. 4, 1998

[54] LIGHT-AND HEAT-SENSITIVE RECORDING MATERIAL AND RECORDING METHOD BY USE THEREOF

[75] Inventors: Eisaku Katoh; Manabu Shibata; Kenzo Nakazawa; Osamu Hatano; Tetsuya Yoshida; Shuji Kida, all of Hino, Japan

[73] Assignee: Konica Corporation, Japan

[21] Appl. No.: 759,014

[22] Filed: Dec. 2, 1996

[30] Foreign Application Priority Data

Dec. 4, 1919 [JP] Japan ..... 7-315350
Dec. 5, 1995 [JP] Japan ..... 7-316689

[51] Int. Cl.[6] ..... B41M 5/30; B41M 5/34; B41M 5/28; G03C 1/00

[52] U.S. Cl. ..... 430/138; 430/333; 430/336; 430/338; 503/201; 503/218; 503/204; 503/227

[58] Field of Search ..... 430/138, 332, 430/333, 336, 337, 338; 503/204, 218, 227, 200, 201

[56] References Cited

U.S. PATENT DOCUMENTS

| | | | |
|---|---|---|---|
| 3,116,143 | 12/1963 | Miller . | |
| 4,006,021 | 2/1977 | Yamashita et al. . | |
| 4,520,378 | 5/1985 | Matsushita et al. . | |
| 4,842,979 | 6/1989 | Ishige et al. | 430/138 |
| 4,985,331 | 1/1991 | Saeki et al. | 430/138 |
| 5,168,029 | 12/1992 | Igarashi et al. . | |

FOREIGN PATENT DOCUMENTS

| | | |
|---|---|---|
| 0109838 | 5/1984 | European Pat. Off. . |
| 63-159845 | 7/1988 | Japan . |
| 2158958 | 11/1985 | United Kingdom . |
| 2199959 | 7/1988 | United Kingdom . |
| 2206218 | 12/1988 | United Kingdom . |

OTHER PUBLICATIONS

Annex Research Disclosure Photographic Printout Elements and Processes 9215, pp. 98–100.

Defensive Publication USPTO, Pub. Aug. 31, 1971 889 O.G. 1363.

*Primary Examiner*—John A. McPherson
*Attorney, Agent, or Firm*—Jordan B. Bierman; Bierman, Muserlian and Lucas

[57] ABSTRACT

A light- and heat-sensitive recording material is disclosed, comprising a support provided thereon a light- and heat-sensitive layer containing a photo-color-forming element comprising a photodecomposable compound and an element capable of forming a color upon reaction with a decomposition product of the photodecomposable compound, wherein the photo-color-forming element is imagewise heated so as to be mixed to thereby form a latent image and the latent image is further exposed to light to form a color; at least one of the photodecomposable compound and the element capable of forming a color upon reaction with the decomposition product of the photodecomposable compound being dispersed through solution in an organic solvent.

11 Claims, No Drawings

LIGHT-AND HEAT-SENSITIVE RECORDING MATERIAL AND RECORDING METHOD BY USE THEREOF

FIELD OF THE INVENTION

The present invention relates to a light- and heat-sensitive recording material which is subjected to heating, followed by exposure to light to form color images and a recording method by use thereof.

BACKGROUND OF THE INVENTION

Thermal recording materials by use of a thermal print-head are broadly employed in a variety of fields such as facsimile machines and printers, due to such features as a simplified recording apparatus, no need of a development process, no noise during recording, no mechanical maintenance and inexpensive operatinging cost. Although conventional thermal recording materials have the above-described features, the color forming reaction occurs merely by application of heat, so that unwanted color-forming inevitably occurs during storage, in particular, when being allowed to stand at a high temperature and high humidity over a long time period.

On the other hand, a photosensitive recording material which is imagewise exposed to light to form a color image has been known as free radical photography. For instance, a method of forming a color image by oxidation of a variety of leuco dyes by use of free radicals produced by exposure to UV light, or a method of obtaining a color image by reacting the photolytically produced free radicals with an aniline derivative to form a triarylmethane type dye, as disclosed in Phot. Sci. Eng., 5, 98–103 (1961); JP-B 43-29407 (herein, the term, "JP-B" is referred to as examined published Japanese Patent), JP-A 55-55335, 57-60329 and 62-66254 (herein, the term, "JP-A" is referred to as an unexamined published Japanese Patent Application). There is also disclosed an image forming material such as Dylux$^R$, produced by du Pont, which involves image formation by exposure to UV light, followed by fixation by activating a photoreducible material with visible light. Image formation only by exposure to light through an original has the advantages that the apparatus and operation are quite simple; however, there are also the disadvantages that handling it is limited to darkroom conditions and its storage stability is poor.

As an example of applying these color forming principles to thermal recording, a light- and heat-sensitive recording material containing a photolytical free radical producing compound and an oxidatively color-forming type leuco dye in a separated state at ordinary temperature is disclosed in JP-A 60-2393. In a thermal recording material of this type, the recording apparatus may be provided with at least a thermal print-head and light source necessary for overall light-exposure and recording can be made through simple operation, without compromising the advantages of conventional thermal recording.

In order to produce a high color density image by use of the above-described light- and heat-sensitive recording material, however, it is required to dissolve and sufficiently mix a free radical producing compound and the leuco dye so that, during the period from heat-recording to light exposure, dissolved and mixed components cool and precipitate, resulting in deterioration of color forming potential.

Further, a light- and heat-sensitive recording material (hereinafter, referred to merely as a recording material) having a coating containing a specific pyrazolone compound and a specific phenol compound and a salicylic acid derivative as color-forming aids is disclosed in JP-A7-237354, in which these compounds are heated and mixed to form a latent image, followed by exposure to UV light to develop a color image. Although the color-forming mechanism of this recording material is not fully understood, it is believed that the pyrazolone compound is photolytically decomposed to form a color forming dye and the phenol compound and salicylic acid derivative accelerate the photolysis. Neither of these compounds above-described is photolyzable by itself.

As described in the above disclosure, the pyrazolone compound is likely to decompose at high temperatures to form color, resulting in such disadvantages that fogging occurs during long-term storage and, in particular, at high temperature and high humidity and that the background portion tints after image recording. It was further found that a color density was lowered when dissolving and mixing by the thermal head was insufficient. As none of these compounds is photodecomposable before being heated and mixed, non-recording portions are not fixed and uncolored portion can be readily changed by reheating and exposing to light.

Each of the above-described recording materials concerns monochromatic color image recording and there was no cited example in the references of its application to multicolor image.

With regard to multicolor thermal recording materials which have so far been proposed, various methods, in which to form independently each color, it was necessary to fix an element recorded at a low temperature, so as to prevent color-forming when recording at a high temperature. As a fixable multicolor thermal recording material is cited a recording material containing a diazonium compound and a coupler, in which the diazonium compound is subjected to thermal recording to form a color image, followed by light exposure to decompose the compound and stop color-forming, and subsequently successive recordings are made.

Although the diazonium could be stabilized by varying its substituent or a counter salt, the diazonium is, however, basically an unstable compound, and particularly unstable in heat and poor in storage stability. Accordingly, there has been a strong desire for a thermal recording material which is stable to heat, and fixable.

JP-A1-129247, 1-143252 and 3-10252 and 3-1983 disclose a recording material in which a free radical photo-producing material and a leuco dye are enclosed on a microcapsule, and outside thereof, a reducing agent is present. There is also described an application of the recording material for multicolor recording, in which the reducing agent is present in the microcapsule and mixed with the free radical producing compound enclosed in the microcapsule during thermal recording, followed by cassation of color-forming, and subsequent overall exposure to form a color in the unheated portion.

However, the above-described recording material has the disadvantage that an oxidative color-forming type leuco dye capable of reacting with the free radical producing compound to form a color and on exposure to roomlight or sunlight during storage over a long period of time, the free radical producing compound is gradually decomposed and produces fog. Therefore, a light- and heat-sensitive recording material which can be easily manipulated and has excellent in storage stability, has been strongly desired.

SUMMARY OF THE INVENTION

Accordingly, an objective of the present invention is to overcome the above described problems in the prior art and to provide a light- and heat-sensitive recording material, in which a recording image is formed by the use of two types of energies, heat and light, and only by heating with a thermal head and simply exposing to light to obtain a multi-color image excellent in color formability without fogging during storage. Another objective of the invention is to provide a light- and heat-sensitive recording material superior in fixability and a recording method by use thereof.

The above-described objectives can be accomplished by the following constitution.

(1) A light- and heat-sensitive recording material comprising a support provided thereon a photo-color-forming element comprising a photodecomposable compound and an element capable of forming a color upon reaction with a decomposition product of the photodecomposable compound, wherein said photo-color-forming element is imagewise heated so as to be mixed and thereby form a latent image and the thus-formed latent image is then exposed to light to form a color; and at least one of the photodecomposable compound and the element capable of forming a color upon reaction with the decomposition product of the photodecomposable compound is dispersed through solution in an organic solvent.

(2) The light- and heat-sensitive recording material described in (1), wherein at least one of the photodecomposable compound and the element capable of forming a color upon reaction with the decomposition product of the photodecomposable compound is encapsulated in microcapsules.

(3) The light- and heat-sensitive recording material described in (1), wherein said photodecomposable compound is a free radical producing compound.

(4) The light- and heat-sensitive recording material described in (1), wherein said element capable of forming a color upon reaction with the decomposition product of the photodecomposable compound is an oxidative-color-forming type leuco dye.

(5) The light- and heat-sensitive recording material described in (1), wherein said element capable of forming a color upon reaction with the decomposition product of the photodecomposable compound comprises a coupler and an aromatic primary amine compound.

(6) The light- and heat-sensitive recording material of claim 1, wherein said photodecomposable compound is an aromatic azide compound, and said element capable reacting with the decomposition product being a coupler.

(7) The light- and heat-sensitive recording material described in (1), wherein the photo-color-forming element which has not heated is exposed to light so that color formability of the non-heated photo-color-forming element is inhibited.

(8) The light- and heat-sensitive recording material described in (1) wherein at least two said photo-color-forming elements are provided.

(9) The light- and heat-sensitive recording material described in (8), wherein said two photo-color-forming elements are each exposed to light at different wavelengths to form colors.

(10) The light- and heat-sensitive recording material described in (8), wherein said two photo-color-forming elements are each heated with different thermal energies to form a latent image.

(11) The light- and heat-sensitive recording material described in (8), wherein said two photo-color-forming elements each form color images different in hue from each other.

(12) The light- and heat-sensitive recording material described in (8), wherein said two photo-color-forming elements each form color images different in density from each other.

(13) The light- and heat-sensitive recording material described in (8), wherein said two photo-color-forming elements are contained in different layers.

(14) The light- and heat-sensitive recording material described in (8), said two photo-color-forming elements are contained in the same layer.

(15) An image forming method by use of a light- and heat-sensitive recording material described in above (1) or (8), comprising the steps of heating imagewise the photo-color-forming element so as to be mixed, thereby forming a latent image and then exposing the formed latent image to light to develop the latent image, forming a color image.

In light- and heat-sensitive recording material of the invention and the image forming method by use thereof, a photo-color-forming element provided on the support is heated to thereby be mixed, followed by light exposure to produce a dye, thereby forming a color image. In a non-heated portion in which the photo-color-forming element has not been mixed, when exposed to light, dye forming reaction does not occur and photolysis of the photodecomposable compound occurs only. In such a light- and heat-sensitive recording material and a recording method by use thereof, a recording apparatus may be a conventional thermal recording apparatus provided with a light source, such as a fluorescent lamp and an excellent color image can be obtained without jeopardizing advantages of the conventional thermal recording. The photodecomposable compound and the element capable of forming a color upon reaction with the decomposition product of the photodecomposable compound are not mixed with each other before being subjected to heating, so that, even in cases where being exposed to a roomlight or allowed to stand for a long period of time, unwanted color forming reaction does not occur and is handling becomes easier.

DETAILED DESCRIPTION OF THE INVENTION

In the invention, the photo-color-forming element preferably comprises a photodecomposable compound and an element capable of forming a color upon reaction with a decomposition product of the photodecomposable compound.

The photodecomposable compound may be any one capable of being decomposed on exposure to light at particular wavelengths, such as UV light, visible light or infrared light, including a free radical photolytically-producing compound (so-called free radical photo-generator), and an azide compound. As examples of the free radical producing compound are cited a 2,4,6-triarylimidazole dimer described in JP-B 62-39728 and 63-2099; 2-azidobenzooxadiazole, benzoylazide and 2-azidobenzimidazole, described in U.S. Pat. No. 3,282,693; a pyridinium compound such as 3'-ethyl-1-methoxy-2-pyridothiacyanine perchlorate, 1-methoxy-2-methylpyridinium-p-toluenesulfonate, described in U.S. Pat. No. 3,615,568; an organic halogen compound such as N-bromosuccinimide, tribromomethylphenylsulfone, diphenyliodide, 2-trichloromethyl-5-(p-butoxystyryl)-1,3,4-oxadiazole and 2,6-bis (trichloromethyl)-4-(p-methoxyphenyl)-s-triazine; a carbonyl compound such as benzophenone, thioxanthone, anthraquinone and benzoin ether; an azo compound such as azobisisobutylonitrile; an organic sulfur compound such as an alkyldisulfide or mercaptan and phosphorus compound such as triphenylphosphine.

The wavelength at which the photodecomposition of the compound takes place can be optionally selected by taking account of handleability as a recording material, availability of a light source to be used and cost. With regard to the handleability as a recording material, for example, if the material is highly sensitive to the wavelength region of such a roomlight, it has a problem in stability, so that the use thereof is limited to handling under darkroom light. To avoid such a limitation, it is preferred to employ the range of from UV region to a partial region of visible light and infrared light. Among these, the light within the range of 300 to 450 nm is preferred, taking account of strength of its energy and no need of using such an expensive material as quartz.

The photodecomposable compound, after being decomposed, produces a dye, upon reaction of its decomposition product with an element capable of forming a color upon reaction with the decomposition product of the photodecomposable compound. The decomposition product may constitute a part of the dye produced or may concern only the dye producing reaction to change to another compound. It depends on a combination of the photodecomposable compound and the element capable of forming a color upon reaction with the decomposition product of the photodecomposable compound and can be selected by taking account of forming efficiency, hue, fastness and extinction coefficient of the dye produced upon the reaction.

As the reaction with the decomposition product of the photodecomposable compound to produce a color forming dye, the following three modes of reaction are cited, though a variety of reactions can be employed.

1.

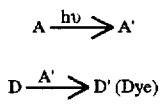

2.

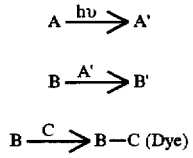

3.

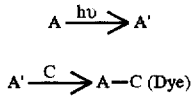

In the above, A represents a photodecomposable compound and A' represent its photodecomposition product. B, C and D represent compounds capable of reacting with A' to form a color. D', B–C and A–C represent formed coloring dyes. B' represents a modified form of B, resulted from the reaction with A'. The above described reaction equations represent schematically reactions of each type, which are useful to understand what each dye skeleton originates from. In the above reactions, an element capable of reacting with A' to form a color may be comprised of a single compound (corresponding to modes 1 and 3) or two kinds of compounds (corresponding to mode 2). It may be comprised of three or more kinds of compounds. An auxiliary component for accelerating dye forming reaction (e.g., base, acid, etc.) may be contained in the photo-color-forming element, though it is not described therein.

In the case of mode 1, thus, the reaction of the photodecomposition product of A with D gives rise to a coloring dye through oxidation or decomposition, therefore, the basic skeleton of the coloring dye originates from D.

In the case of mode 2, one of the color forming elements, B reacts with A', giving rise to an activated species (through a change such as oxidation or decomposition), which further reacts with another color forming element, C (through such as coupling reaction) to form a coloring dye. In this case, the basic skeleton of the formed dye originates from B and C.

In the case of mode 3, A' reacts with C (through such as coupling reaction) to a dye. In this case, the basic skeleton of the dye originated from A and C, which is different from the case of mode 1.

As examples of mode 1, the photodecomposable compound is a free radical producing compound such as a 2,4,6-triarylimidazole dimer compound or an organic halogen compound; and the element capable of forming a color upon reaction with the decomposition product of the photodecomposable compound is a leuco dye. In this case, the decomposition product formed upon exposure to light is an imidazolyl free radical or halogen free radical, which have strong oxidizing ability. Using the strong oxidizing ability, for example, the leuco dye is oxidized to form a coloring dye. of the leuco dyes (in other words, oxidative-color-forming type leuco dyes) are usable those described in U.S. Pat. No. 3,445,234 and representative structures thereof are shown as below.

1) Aminotriarylmethane
2) Aminoxanthene
3) Aminothioxanthene
4) Amino-9,10-dihydroacridine
5) Aminophenoxazime
6) Aminophenothiazine
7) Aminodihydrophenazine
8) Aminodiphenylmethane
9) Leucoindamine
10) Aminohydrocinnamic acid
11) Hydrazine
12) Leucoindigoid dye
13) Aminodihydroanthraquinone
14) 4,4'-Biphenol
15) 2-(p-Hydroxyphenyl)-4,5-diphenylimidazole
16) Phenethylaniline Exemplary compounds include leucocrystal violet, tris(4-dimethylamino-o-tolyl)methane, bis(4-dimethylamino-o-tolyl)phenylmethane, bis(4-dimethylamino-o-tolyl) thienylmethane, 2-(2-chlorophenylamino-6-N,N-dibutylamino-9-(2-methoxycarbonyl)-phenylxanthene, 2-N,N-dibenzylamino-6-N,N-diethylamino-9-(2-methoxycarbonyl) phenylxanthene, benzo[a]-6-N,N-diethylamino-9-(2-methoxycarbonyl)phenylxanthene, benzoylleucomethylene blue, benzoyl-3,7-diethylaminophenoxazine, benzoyl-3,7-diethylamino-9-phenyldihydrophenazine, 6,6'-di-t-butyl-p,p'-bi-o-cresol.

Of these, preferred leuco dyes include triarylmethane type leuco dyes such as tris(4-dimethylamino-o-tolyl)methane and acylated leucoazine type dyes such as benzoylleucomethylene blue, benzoyl-3,7-diethylaminophenoxazine and benzoyl-3,7-diethylamino-9-phenyldihydrophenazine.

Examples of the free radical producing compound used in combination with the above-described leuco dye include a 2,4,6-triarylimidazole dimer compound and an organic halogen compound such as tribromomethylphenylsulfone and 2,6-bis (trichloromethyl)-4-(p-methoxyphenyl)-s-triazine.

These free radical producing compounds are able to increase inherent sensitivity and spectral sensitivity in combined use of a variety of sensitizers. Exemplary sensitizers are referred to those described in K. Tokumaru and M. Ohgahara "Zohkanzai" (Sensitizers) Kodansha (1987) pp. 64–75.

As examples of mode 2, the photodecomposable compound is a free radical producing compound, of which decomposition product has oxidizing ability similar to the case of mode 1 and the element capable of forming a color upon reaction with the decomposition product of the photodecomposable compound to form a color is a coupler and aromatic primary amine compound. As well known in the field of silver halide photographic light sensitive materials, aromatic primary amines such as N,N-diethyl-p-phenylenediamine and 4-aminoantipyrine undergo oxidative coupling reaction with phenols or active methylene compounds to form an azomethine dye. Accordingly, using the above-described free radicals, the oxidative coupling reaction is also caused to occur to form a dye.

Usable aromatic primary amine compounds include, besides the above-described amines, p-aminophenol, N-ethyl--N-methanesulfonylaminoethyl-2-methyl-p-phenylenediamine and N,N-didodecyl-p-phenylenediamine. The aromatic primary amines may be optionally used in the form of hydrochloride, sulfate, tosylate or perfluoroalkylsulfonate. Acyl forms such as an acetyl, benzoyl, p-toluenesulfonyl, (2,4-di-t-pentylphenoxy) acetyl and p-dodecyloxyphenylsufonyl may be used. Of these, preferred aromatic primary amines include aminoantipyrine, perfluoroalkylsulfonates of N,N-dialkylamino-p-phenylenediamine derivatives.

As couplers capable of oxidative-coupling with the aromatic primary amine to form a dye are usable those known in the field of silver halide color photographic materials. Examples thereof are referred to U.S. Pat. Nos. 2,772,162, 2,895,826, 3,002,836, 3,034,892, 2,474,293, 2,423,730, 2,367,531, 3,041,236, 4,333,999, 2,600,788, 2,369,869, 2,343,703, 2,311,082, 3,152,896, 3,519,429, 3,062,653, 2,908,573, 2,875,057, 2,470,210, 3,265,506, 2,298,443, 3,048,194 and 3,447,928; and Agfa Mitteilungen, Farbkupplereine Literraturueberesicht vol. III pp. 112–175 (1961). Of these, preferred couplers include phenols, naphthols, pyrazolones, pyrazolotriazoles and acylacetoanilides.

Any of two-equivalent coupler of which coupling position is substituted by a leaving group and four-equivalent coupler with no substituent on the active point may be usable. As the reaction with the coupler may be accelerated by the use of a base, the base may be optionally used in combination. As bases are usable organic bases such as triphenylguanidine, trihexylamine, pyridine and quinoline, inorganic base such as sodium hydrogencarbonate, potassium carbonate, potassium hydroxide and salicylic acid metal salt and metal salts of organic acids.

As an example of mode 3, in cases where the photodecomposable compound is an aromatic azide compound, an element capable of forming a color upon reaction with the decomposition product of the photodecomposable compound includes couplers. The aromatic azide compound is photolyzed to form a nitrene. The formed nitrene is reacted with the above-described coupler to form the azomethine dye.

Usable aromatic azide compounds include 4-(N,N-diethylamino) phenylazide, 2,5-dibutoxy-4-morpholinophenylazide, 2,5-dibutoxy-4-phenylthiophenylazide, 4-(N-ethyl-N-methylsulfonylaminoethylamino)-2-methylphenylazide, 4-diethylamino- 3-dodecyloxycarbonylphenylazide, 1-naphthylazide, 2-naphthylazide, anthranylazide, 3-quinolineazide and 9-acridineazide. Examples of preferred aromatic azides include p-dialkylaminophenylazides. As examples of couplers capable of coupling with the azides are cited the same ones as described above.

The total number of carbon atoms of each components of the photodecomposable compound and the color forming element upon reaction with the decomposition product is preferably 10 or more so as to enhance the solubility in an organic solvent used. In cases where the molecular weight becomes to high, a color density per unit weight tends to decrease, so that the total number of carbon atoms is more preferably 15 to 40.

In the invention at least two kinds of photo-color-forming elements are usable optionally in various forms. For example, images with two kinds of colors can be formed by the use of two kinds of the photo-color-forming elements forming colors different in hue from each other. In this case it is possible to recording with an apparently one color by forming simultaneously two kinds of colors upon the thermal recording and one light-exposure and it is also possible to separately record two colors.

Separate recording of two kinds of colors can be achieved by causing two kinds of photo-color-forming elements to form colors, using lights having different wavelengths from each other. Thus, after each of the photo-color-forming elements is mixed up by thermal recording to form a latent image, it is possible to cause the two photo-color-forming elements to form independently two kinds of colors by exposure of a specific portion to light with wavelengths, at which a first color forming element is capable of color-forming and a second color forming element is not, to form a first color, followed by exposure of another portion to light with wavelengths at which the second element is capable of color-forming. Alternatively, it is possible to form a mixture of two colors by exposing to light with wavelengths at which both color-forming elements are capable of forming colors. In this case, an extent of color-forming of the two elements can be controlled by the wavelength of light to be exposed.

It is also possible to record separately two kinds of colors by causing the two elements to form latent images by different thermal energies. Thus, exposure to a first thermal energy causes only one photo-color-forming element to form a latent image, followed by exposure to a second thermal energy causing the other element to form a latent image. Thereafter, exposure to light with wavelengths at which the first and second elements are capable of color-forming enables to record separately two kinds of colors. In this case, when recorded with the second thermal energy, latent image formation occurs also in the first element, so that one of the resulting color recording images is resulted from color-forming of the first element and the other one is resulted from the first and second elements.

Further, before recording with the second thermal energy, latent image formation of the first element is caused by the first thermal energy, followed by exposure to light with the wavelength at which only the first element is capable of color-forming, causing the first element to form a color and after causing color formability of a nonrecorded portion of the first element to stop, latent image formation of the second element is caused by a second thermal energy, followed by exposure to light to form a color. Thus, a color image produced by the first photo-color-forming element and a color image produced by the second element can be separately formed.

Furthermore, it is possible to cause two photo-color-forming elements to form a color in the same hue. For example, if a shade of the image to be recorded can be finely reflected on a color density though difference of thermal energy to be applied, a recording image excellent in reproduction is obtained. However, it is limitative to provide a shade of color using a single color-forming element and a wide range of temperature. Instead thereof, it is possible to obtain a finer color image by providing plural photo-color-forming elements such as to form colors with an identical hue and higher density at a higher temperature.

In the invention, two kinds of the photo-color-forming elements may be optionally contained together in the same layer or separately in at least two layers. In cases where color formation of the two elements are allowed to proceed at the same time to obtain a mixed color, color formation of the two elements containing a component in common with each other is allowed to proceed separately by heat and/or light, or the two elements forming a color with substantially the same hue and different in density are employed, for example, the two elements can be contained in the same layer.

Two kinds of the photo-color-forming elements may be individually contained in separate layers. In cases where contained in separated layers, component(s) of each element can be readily separated because of the layers being different and heat conduction can be varied by controlling the layer, so that, when the two elements are mixed up by thermal recording to form two colors, separation of the two colors can be easily made.

In the invention, all components contained in the photo-color-forming element are not to be homogeneously mixed up before being heated. At least one component of the element needs to be separated from other component(s) by any means, before being heated. When heated by a thermal print head, it is promptly mixed, causing color forming reaction to occur only in the mixing portion, upon exposure to light. If the photo-color-forming element is promptly melted, thereby, mixed up and each component is able to be maintained in the molten state until being subjected to exposure, a high color density can be obtained. At least one component of the photo-color-forming element is preferably dispersed through solution in an organic solvent. Thus, it is preferred that at least one component of the photo-color-forming element is incorporated in a layer, in the form of a dispersion, which is prepared by dissolving it in an organic solvent and then dispersing the resulting solution in an aqueous medium containing a protective colloid.

Of the organic solvents usable in the invention, those having a high boiling point are preferred. Examples of the high boiling solvents include phosphates, phthalates, acrylates, methacrylates or other carboxylic esters, fatty acid amide, alkylated biphenyls, alkylated terphenyls, chlorinated paraffins, alkylated naphthalenes, diarylethanes and dialkylphenols. Concretely, those described in JP-A 60-242094 and 62-75409 are usable.

Of the boiling point of the organic solvent to be used, it is desired to be nonvolatile at an ordinary temperature and solvents having a boiling point of 100° C. or higher are preferred. In case of the boiling point being too high, viscosity tends to be increased so that ones having a boiling point of 120° to 500° C. are more preferable.

In addition to the above-described high boiling solvents, a low boiling solvent such as ethyl acetate or methylene chloride, as a dissolution-aid, may be used in combination.

As a separating method applicable in the invention, it is possible to prevent each component from homogeneously mixing by emulsified dispersion or solid particle dispersion thereof. In order to separate securely, components to be separated during storage are separated into separate layers to be coated. An interlayer may be effectively provided between the layers.

As preferred separation form is cited enmicrocapsulation. Microcapsules preferably used in the invention have a microcapsule wall of such property as to prevent the contact between substances present inside and outside the microcapsule at ordinary temperature through its insulating function, but to increase a permeability of the substances only while it is heated to a temperature higher than a prescribed temperature. Permeability variable with temperature can be freely controlled by optimally selecting a capsule wall, a capsule core material, and additives.

Examples of microcapsule wall materials usable in the invention include a polyurethane, polyurea, polyamide, polyester, polycarbonate, polyether, polycarbonate, urea-formaldehyde resin, melamine-formaldehyde resin, polystyrene, styrene-methacrylate copolymer, gelatin, poly (vinylpyrrolidone), and poly(vinyl alcohol). These materials can be used in combination thereof. Among the above-described wall materials, a polyurethane, polyurea, polyamide, polyester, and polycarbonate are preferred, and polyurea and polyurethane are more preferred. Microcapsules preferably used in the invention are described in detail in U.S. Pat. No. 3,796,696.

The microcapsules used in the invention are preferably manufactured in a method by interfacial polymerization in which a core material containing a substance to be enmicrocapsulated is emulsified to form a emulsion in the form of oil drops dispersed in a medium and then a wall of a macromolecular substance is formed around the oil drops to form microcapsules. In this case, to form emulsified oil drops, an organic solvent is preferably employed and in general, organic solvents to be employed are optimally selected from high boiling organic solvents. Examples thereof include a phosphate, phthalate, fatty acid amide, alkylated biphenyl, alkylated terphenyl, chlorinated parafin, alkylated naphthalene and diarylethane. Exemplary examples are described in JP-A 60-24209 and 62-75409.

In addition to the above-described high boiling solvents, a low boiling solvent such as ethyl acetate or methylene chloride, as a dissolution-aid, may be used in combination. On the other hand, in a water phase to be mixed with a oil phase may be contained a water-soluble polymer, as a protective colloid, such as poly(vinyl alcohol), gelatin and cellulose derivatives. A surfactant selected from ones known in the art can be used in emulsion-dispersing so as to prevent precipitation and coagulation. Other color forming element (s) present outside the microcapsules may be dispersed in either form of an emulsified dispersion or solid particle dispersion, preferably, in the form of an emulsified dispersion. In the solid particle dispersion, emulsified dispersion and a dispersion used in the microcapsules, the particle size of a dispersed phase is preferably within the range of 0.1 to 20 μm, more preferably, 0.5 to 10 μm, from the standpoint of image quality and color density.

According to the present invention, color forming reaction occurs at a portion in which, on being heated, a photodecomposable compound is mixed with an element capable of forming a color upon reaction with the decomposition product of the photodecomposable compound of the compound to form a color. On the other hand, at a non-heated portion, i.e., a portion separated from the element capable of forming a color upon reaction with the decomposition product of the photodecomposable compound, no color forming reaction occurs even when exposed to light. Preferably, when the nonheated portion is exposed to light, the photodecomposable compound is photolyzed, changing to substantially inert compound as a result of reaction with surrounding materials, without participating in color forming reaction.

In the invention, the amount of the photodecomposable compound or the element capable of forming a color upon reaction with the decomposition product of the photodecomposable compound is not limitative and is chosen taking account of a thickness of a layer coated on a support, color-forming efficiency, color density, etc. Either of them is preferably used in an amount of $4\times10^{-4}$ mol to $2\times10^{-2}$ mol/m$^2$.

Of the layer thickness to be coated on the support, it is not limitative, but taking account of heat-sensitivity and image sharpness, a dry layer thickness is preferably within the range of 0.5 to 50 μm, more preferably, 1 to 20 μm.

The light- and heat-sensitive recording material of the invention can be manufactured by coating, on a support, the photodecomposable compound and the element capable of forming a color upon reaction with the decomposition product of the photodecomposable compound of the compound to form a color. In this case, as a binder of the above-described dispersion are usable various emulsions of poly(vinyl alcohol), gelatin, styrene-butadiene latex, carboxymethyl cellulose, arabic gum, poly(vinyl pyrrolidone, and a polyacrylate. The amount to be used is 0.5 to 5 g/m$^2$, in terms of a solid component.

In the recording material of the invention, taking account of image protection, prevention of adhesion of recording materials, prevention of adhesion to a thermal head, writability, and surface roughness, a protective layer is preferably provided. As binders of the protective layer, those known in the art are usable. Examples thereof include polymers, such as methyl cellulose, carboxymethyl cellulose, hydroxymethyl cellulose, starches, gelatin, arabic gum, casein, hydrolytic product of styrene-maleic acid copolymer, poly(vinyl alcohol), carboxy-modified poly (vinyl alcohol), polyacrylamide derivatives, poly(vinyl pyrrolidone), sodium poly(styrenesulfonate), sodium alginate, styrene-butadiene latex, acrylonitrile-butadiene rubber latex, and poly(vinyl acetate) emulsion; silicone resin, melamine resin, phenol resin, acryl resin, polyester resin, epoxy resin, fluororesin, nitrocellulose, cellulose acetatepropionate, cellulose acetate, fluoronated vinylidene resin, and chlorinated rubber. As a filler of the protective layer, inorganic pigments, such as zinc oxide, calcium carbonate, barium sulfate, titanium oxide, litbon, talc, agalmatolite, kaolin, aluminum hydroxide, amorphous silica, colloidal silica; organic pigments, such as polystyrene, poly(methyl methacrylate), polyethylene, vinyl acetate resin, vinyl sulfide resin, vinylidene sulfide resin, styrene-methacrylate copolymer, chlorovinylidene, polyurea, and melamine-formaldehyde; and waxes, such as parafin wax, microcrystalaline wax, carnauba wax, methylol steariloamide, polyethylene wax, and silicone. These fillers may be used singly or in combination thereof.

The light- and heat-sensitive recording material of the invention is coated on a support such as paper or synthetic resin film in well-known manners, such as a dip coating method, air-knife coating method, curtain coating method, roller coating method, doctor blade coating method, wire-bar coating method, slide coating method, gravure coating method, spin coating method and extrusion coating method. As supports usable in the light- and heat-sensitive recording material of the invention mention may be made of papers; films such as regenerated cellulose, cellulose acetate, cellulose nitrate, poly(ethylene terephthalate), polyethylene, poly (vinyl acetate), and poly(ethylene naphthalate); glass; wood; and metals. light sources usable in the invention are any of those capable of photolyzing the photodecomposable compound, including fluorescent lamps, high pressure mercury lamp, xenon lamp, tungsten lamp and solar light.

EXAMPLES

Examples of embodiments of the present invention will be shown as below, but the invention should not be construed as being limited to these examples. Hereinafter, the word, "part(s)" refers to part(s) by weight.

Example 1

Preparation of capsule solution A

| | |
|---|---|
| Leuco dye; bezoylleucomethylene blue | 1 part |
| Wall material; Xylyrenediisocyanate/ trimethylolpropane adduct | 15 parts |
| Additive; Dodecybenzenesulfonic acid | 0.4 part |
| Dissolution-aid; Methylene chloride | 5 parts |
| High boiling solvent; 1-Phenylene-1-xylylethane (b.p. 312° C.) | 5 parts |

The above composition was homogeneously dissolved. The resulting solution was added to 54 parts of 6% poly (vinyl alcohol) aqueous solution and the mixture was dispersed at 20° C. using a homogenizer to obtain an emulsion having an average oil-drop size of 1 μm. The emulsion was added water of 60 parts and stirring was further continued at 40° C. for 3 hrs. Thereafter, the solution was returned to room temperature to obtain a capsule solution A. The glass transition temperature of capsule wall was 80° C.

Preparation of dispersion of free radical producing compound

Tribromomethylphenylsulfone of 30 parts was added to 4% poly(vinyl alcohol) aqueous solution of 150 parts and the mixture was dispersed by a sand mill to obtain a dispersion of tribromomethylphenylsulfone having an average oil-drop size of 1 μm.

A coating solution having the following composition was prepared.

| | |
|---|---|
| Capsule solution A | 12 parts |
| Dispersion of free radical producing compound | 3 parts |

The coating solution was coated on wood free paper by a wire-bar so as to have a coating amount of the leuco dye of 0.5 g/m$^2$ and dried at 50° C. to obtain a light- and heat-sensitive recording material of the invention.

Example 2

A light- and heat-sensitive recording material of the invention was prepared in the same manner as in Example 1, except that the leuco dye was replaced by an equimolar amount of leucocrystal violet.

Example 3

| | |
|---|---|
| Coupler; 2,4-Dichloro-3-ethyl-6-[2-(2,4-di-t-pentylphenyloxy[)butanoylamino]phenol | 1.5 parts |
| Additive; Dodecylbenzenesulfonic acid | 0.4 parts |
| Wall material; Xylylenediisocyanate/trimethylol propane adduct | 15 parts |
| Dissolution-aid; Ethyl acetate | 5 parts |
| High boiling solvent; Isopropylbiphenyl (b.p. 295° C.) | 5 parts |

The above composition was homogeneously dissolved. The resulting solution was added to 54 parts of 6% poly (vinyl alcohol) aqueous solution and the mixture was dispersed at 20° C. using a homogenizer to obtain an emulsion having an average oil-drop size of 1 μm. The emulsion was added water of 60 parts and stirring was further continued at 40° C. for 3 hrs. Thereafter, the solution was returned to room temperature to obtain a capsule solution B.

Preparation of free radical producing compound/amine dispersion

| | |
|---|---|
| 2,2'-Bis-(o-chlorophenyl)-4,4',5,5'-tetraphenylbisimidazole | 5 parts |
| N,N-Dioctylamino-p-phenylenediamine | 10 parts |
| Triphenylguanidine | 5 parts |
| Methylene chloride | 30 parts |
| Tricresyl phosphate (b.p. 265° C./10 mmHg) | 30 parts |

The above composition was added to 4% poly(vinyl alcohol) aqueous solution of 200 parts and the mixture was dispersed by a ultrasonic homogenizer to obtain a dispersion.

A solution having the following composition was prepared

| | |
|---|---|
| Capsule solution B | 10 parts |
| Free radical producing compound/amine dispersion | 20 parts |

The coating solution was coated on wood free paper by a wire-bar so as to have a coating amount of the coupler of 0.35 g/m$^2$ and dried at 50° C. to obtain a light- and heat-sensitive recording material of the invention.

Example 4

Preparation of capsule solution C

| | |
|---|---|
| Azide; 4-Morpholino-2,5-dibutoxyphenylazide | 3 parts |
| High boiling solvent; Diisopropylnaphthalene (b.p. 318° C.) | 10 parts |
| Wall material; Xylylenediisocyanate/trimethylolpropane adduct | 8 parts |
| Dissolution-aid; Ethyl acetate | 5 parts |

The above composition was homogeneously dissolved. The resulting solution was added to 8% phthalated gelatin aqueous solution of 46 parts and adding thereto water of 18 parts and 10% sodium dodecylbenzenesulfonate aqueous solution of 2 parts, the mixture was dispersed at 20° C. by a homogenizer to obtain an emulsion having an average oil-drop size of 1 μm. To the emulsion was added water of 20 parts and the emulsion was further stirred at 40° C. for 3 hrs. and returned to room temperature to obtain capsule solution C.

Preparation of coupler dispersion

| | |
|---|---|
| 7-Chloro-6-tert-butyl-3-(3-dodecylsulfonyl propyl)pyrazolo[3,2-c]triazole | 4 parts |
| Triphenylguanidine | 2 parts |
| Tricresylphosphate | 1 part |

The above composition was homogeneously mixed and adding thereto gelatin (15% aqueous solution) of 32 parts, dodecylbenzenesulfonic acid (10% aqueous solution) of 5 parts and water of 30 parts, the mixture was emulsified at 20 k C for 10 min. to obtain an emulsion. The emulsion was further stirred at 40° C. for to remove ethyl acetate and then water was added in an amount equivalent to ethyl acetate removed to obtain a coupler dispersion.

A coating solution of the following composition was prepared.

| | |
|---|---|
| Capsule solution C | 6 parts |
| Coupler dispersion | 8 parts |
| Gelatin (15% aqueous solution) | 2 parts |
| Water | 4.5 parts |

The coating solution was coated on wood free paper by a wire-bar so as to have a coating amount of the azide of 0.2 g/m$^2$ and dried at 50° C. to obtain a light- and heat-sensitive recording material of the invention.

Comparative Example 1

A comparative sample (Comparison 1) was prepared in the same manner as Example 1, except that, in the capsule solution, 1-phenyl-1-xylylethane was not added.

Comparative Example 2

A comparative sample (Comparison 2) was prepared in accordance with Example 1 of JP-A 3-1983, as follows.

| | |
|---|---|
| Leuco dye; Leucocrystal violet | 1.5 parts |
| Photooxidizing agent; 2,2'-Bis-(o-chlorophenyl)-4,4'5,5'-tetraphenylbisimidazole | 3.0 parts |
| Wall material; Xylylenediisocyanate/trimethylolpropane adduct | 24 parts |
| Dissolution-aid; Methylene chloride | 5 parts |
| High boiling solvent; Tricresylphosphate | 24 parts |

The above composition was homogeneously mixed and the solution was added to a mixture of 8% poly(vinyl alcohol) aqueous solution of 63 parts and distilled water of 100 parts. The mixed solution was emulsified at 20° C. by a homogenizer to obtain an emulsion having an average oil-drop size of 1 μm. The emulsion was further stirred at 40° C. for 3 hrs. and returned to room temperature to obtain a capsule solution.

Next, phenidone A (1-phenylpyrazolidinedione-3-one) of 42 g was dissolved in diethyl maleate of 8 g and ethyl acetate of 30 g. The resulting solution was mixed with 8% poly (vinyl alcohol) aqueous solution of 100 g and sodium dodecylbenzenesulfonate aqueous solution of 0.5 g and the mixture was emulsified by a homogenizer to obtain an emulsified dispersion containing phenidone A.

A mixture of the above-described capsule solution of 9 parts and phenidone A containing emulsion was coated on a wood free paper by a wire-bar so as to have the same coating amount of the leuco dye as in Example 1 and dried at 50° C. to obtain comparative sample-2. Contrary to light- and heat-sensitive recording materials of the invention, no color forming occurred in a portion which had been heated and exposed, and in a portion which had been only exposed, color formation was observed.

Color formation/Row stock stability test

Thus-obtained light- and heat-sensitive recording materials were subjected to heating at 120° C. for 5 sec. (0.5 kg/m$^2$), using a heat-gradient tester (produced by Toyo Seiki) and then exposed overall for 30 sec. using a high pressure mercury lamp.

Prior to recording, the light- and heat-sensitive materials were allowed to stand at high temperature and high humidity (50 k C and 80% R.H.) for 3 days and thereafter, the recording materials were subjected to heating and exposure to light in the same manner as above to measure densities of the background and color forming portion.

TABLE 1

| | | Before aging | | After aging | |
|---|---|---|---|---|---|
| | Color | Heated portion | Non-heated portion | Heated portion | Non-heated portion |
| Example 1 | Blue | 1.26 | 0.07 | 1.22 | 0.10 |
| Example 2 | Blue | 1.30 | 0.08 | 1.26 | 0.12 |
| Example 3 | Cyan | 1.38 | 0.06 | 1.30 | 0.08 |
| Example 4 | Magenta | 1.45 | 0.05 | 1.40 | 0.07 |
| Comparison 1 | Blue | 0.50 | 0.07 | 0.46 | 0.20 |
| Comparison 2 | Blue | 0.12 | 1.16 | 0.35 | 1.06 |

As can be seen from the above results, it was proved that inventive light- and heat-sensitive recording materials and recording methods by use thereof were excellent in color formation of the heat-recording portion and little in fogging of the nonheated portion even after being allowed to stand at high temperature and high humidity.

Samples obtained in Examples 1 through 4 were exposed overall to high pressure mercury lamp for 1 min. and then heating and exposure were repeated. As a result, comparing to samples before heating and exposure, no significant difference in color formation was observed. Thus, it was confirmed that color formability of a portion in which no latent image was formed by heating was stopped.

Example 5

Preparation of capsule solution A

| | |
|---|---|
| Leuco dye; Leucocrystal violet | 1 part |
| Wall material; Xylylenediisocyanate/ trimethylolpropane adduct | 20 parts |
| Additive; Dodecybenzenesulfonic acid | 0.4 part |
| Dissolution-aid; Ethyl acetate | 16 parts |
| High boiling solvent; Isopropylnaphthalene | 5 parts |

The above composition was homogeneously dissolved. The resulting solution was added to 54 parts of 6% poly (vinyl alcohol) aqueous solution and the mixture was dispersed at 20° C. using a homogenizer to obtain an emulsion having an average oil-drop size of 1 μm. The emulsion was added water of 60 parts and stirring was further continued at 40° C. for 3 hrs. Thereafter, the solution was returned to room temperature to obtain a capsule solution A. The glass transition temperature of capsule wall was 80° C.

Preparation of capsule solution B

| | |
|---|---|
| Leuco dye; 3,6-Dimethoxy-9-(2-methoxycarbonyl)-phenyl xanthene | 1.5 part |
| Wall material; Tolylenediisocyanate/trimethylol-propane adduct (75% ethyl acetate solution) | 20 parts |
| Dissolution-aid; Ethyl acetate | 5 parts |
| High boiling solvent; Diisopropylnaphthalene | 5 parts |

The above composition was homogeneously dissolved. The resulting solution was added to 54 parts of 6% poly (vinyl alcohol) aqueous solution and the mixture was dispersed at 20° C. using a homogenizer to obtain an emulsion having an average oil-drop size of 1 μm. The emulsion was added water of 60 parts and stirring was further continued at 40° C. for 3 hrs. Thereafter, the solution was returned to room temperature to obtain a capsule solution A. The glass transition temperature of capsule wall was 100° C.

Preparation of dispersion of free radical producing compound:

Tribromomethylphenylsulfone of 5 parts and 2,2'-bis-(o-chlorophenyl)-4,4',5,5'-tetraphenylbisimidazole of 25 parts were added to 4% poly(vinyl alcohol) aqueous solution of 150 parts and the mixture was dispersed by a sand mill to obtain a dispersion of tribromomethylphenylsulfone having an average oil-drop size of 1 μm.

A coating solution having the following composition was prepared.

| | |
|---|---|
| Capsule solution A | 12 parts |
| Capsule solution B | 12 parts |
| Dispersion of free radical photoproducing compound | 5 parts |

The coating solution was coated on wood free paper by a wire-bar so as to have a coating amount of the leuco dye (capsule B) of 0.5 g/m$^2$ and dried at 50° C. to obtain a light- and heat-sensitive recording material of the invention.

The resulting light- and heat-sensitive recording material was subjected to heating at 90° C. and 110° C. (0.5 kg/m$^2$) for 5 sec. and exposed to a high pressure mercury lamp for 30 sec. As a result, a portion heated at 90° C. exhibited vivid yellow color formation and the other portion heated at 110° C. exhibited black color formation. Further, nonheated portion was not colored.

After overall exposure above-described, a nonheated portion of the recording material was again subjected to heating and exposure, but no significant color formation was observed.

The hue obtained by causing the leuco dye used in capsule A to form a color was yellow and that of capsule B was blue. It is anticipated that the portion heated at 90° C. resulted color formation of a leuco dye of capsule A on exposure to exhibit blue and, on the other hand, the portion heated at 110° C. resulting in simultaneous color formation of leuco dyes of capsule A and B to exhibit black color.

Example 6

Preparation of capsule C

| | |
|---|---|
| Coupler; 2,4-Dichloro-3-ethyl-6-2-[2-(2,4-di-t-pentylphenyloxy)butanoylamino]phenol | 1.5 parts |
| Additive; Dodecylbenzenesulfonic acid | 0.4 parts |
| Wall material; Xylylenediisocyanate/ trimethylol propane adduct | 20 parts |

-continued

| | |
|---|---|
| Dissolution-aid; Ethyl acetate | 5 parts |
| High boiling solvent; Isopropylbiphenyl (b.p. 295° C.) | 5 parts |

The above composition was homogeneously dissolved. The resulting solution was added to 54 parts of 6% poly (vinyl alcohol) aqueous solution and the mixture was dispersed at 20° C. using a homogenizer to obtain an emulsion having an average oil-drop size of 1 μm. The emulsion was added water of 60 parts and stirring was further continued at 40° C. for 3 hrs. Thereafter, the solution was returned to room temperature to obtain a capsule solution C.

Preparation of free radical producing compound/amine dispersion

| | |
|---|---|
| 2,2'-Bis-(o-chlorophenyl)-4,4',5,5'-tetraphenylbisimidazole | 4 parts |
| 2,6-Bistrichloromethyl-4-methoxyphenyl-s-triazine | 2 parts |
| N,N-Dioctylamino-p-phenyldiamine-perfluorobutanesulfonate | 10 parts |
| Triphenylguanidine | 5 parts |
| Methylene chloride | 30 parts |
| Tricresyl phosphate | 30 parts |

The above composition was added to 4% poly(vinyl alcohol) aqueous solution of 200 parts and the mixture was dispersed by a ultrasonic homogenizer to obtain an emulsified dispersion.

A coating solution of the following composition was prepared.

| | |
|---|---|
| Upper layer coating solution: | |
| Above-described capsule solution C | 10 parts |
| Above-described dispersion of free radical photoproducing compound | 20 parts |
| Lower layer coating solution: | |
| Capsule solution prepared in Example 5 | 10 parts |
| Dispersion of free radical photoproducing compound, prepared in Example 5 | 3 parts |

These coating solutions were coated on wood free paper by a wire-bar so as to have a coupler coating amount of 0.5 g/m$^2$ and dried at 50° C. to obtain a light- and heat-sensitive recording material of the invention.

Thus prepared light- and heat-sensitive recording material was partially heated at 90° C., using a heat-gradient tester (produced by Toyo Seiki) and then exposed, for 30 sec., to high pressure mercury lamp, in which light at the wavelengths of 400 nm or less was cut off with a filter. A heated portion exhibited a vivid cyan color. On the other hand, no color formation was observed in a non-heated portion. Thereafter, the non-heated portion was further heated at 110° C. for 5 sec. (0.5 kg/m$^2$) and exposed overall to a high pressure mercury lamp. As a result, the re-heated portion exhibited a vivid yellow color and the non-heated portion formed no color. It is understood that the dispersion of free radical producing compound contained in the upper layer responded to light with a wavelength of more than 400 nm and heatedly mixed with the amine and coupler to form a cyan color; on the other hand, the dispersion of free radical producing compound of the lower layer responded to light with a wavelength of 400 nm or less and formed a yellow color upon reaction with the leuco dye. Furthermore, from the fact that no cyan color formation of the upper layer was observed even when exposed to light with a wavelength of 400 nm or more and then subjected to heating and exposure, it is apparent that upon exposure, color formation of the heated portion and prevention of color formation of the non-heated portion occurred.

Example 7

Preparation of capsule solution D

| | |
|---|---|
| Azide; 4-Morpholino-2,5-dibutoxyphenylazide | 3 parts |
| High boiling solvent; Diisopropylnaphthalene | 10 parts |
| Wall material; Xylylenediisocyanate/trimethylolpropane adduct (75% ethyl acetate solution) | 20 parts |
| Dissolution-aid; Ethyl acetate | 5 parts |

The above composition was homogeneously dissolved. The resulting solution was added to 8% phthalated gelatin aqueous solution of 46 parts and adding thereto water of 18 parts and 10% sodium dodecylbenzenesulfonate aqueous solution of 2 parts, the mixture was dispersed at 20° C. by a homogenizer to obtain an emulsion having an average oil-drop size of 1 μm. To the emulsion was added water of 20 parts and the emulsion was further stirred at 40° C. for 3 hrs. and returned to room temperature to obtain capsule solution D.

Preparation of capsule solution E

| | |
|---|---|
| Azide; 4-Morpholino-2,5-dibutoxyphenylazide | 6 parts |
| High boiling solvent; Diisopropylnaphthalene | 10 parts |
| Wall material; Tolylenediisocyanate/trimethylolpropane adduct (75% ethyl acetate solution) | 20 parts |
| Dissolution-aid; Ethyl acetate | 5 parts |

The above composition was homogeneously dissolved. The resulting solution was added to 8% phthalated gelatin aqueous solution of 46 parts and adding thereto water of 18 parts and 10% sodium dodecylbenzenesulfonate aqueous solution of 2 parts, the mixture was dispersed at 20° C. by a homogenizer to obtain an emulsion having an average oil-drop size of 1 μm. To the emulsion was added water of 20 parts and the emulsion was further stirred at 40° C. for 3 hrs. and returned to room temperature to obtain capsule solution Preparation of coupler dispersion

| | |
|---|---|
| 7-Chloro-6-tert-butyl-3-(3-dodecylsulfonyl propyl)pyrazolo[3,2-c]triazole | 4 parts |
| Tricresylphosphate | 1 part |

The above composition was homogeneously mixed and adding thereto gelatin (15% aqueous solution) of 32 parts, dodecylbenzenesulfonic acid (10% aqueous solution) of 5 parts and water of 30 parts, the mixture was emulsified at 20° C. for 10 min. to obtain an emulsion. The emulsion was further stirred at 40° C. for to remove ethyl acetate and then water was added in an amount equivalent to ethyl acetate removed to obtain a coupler dispersion. A coating solution of the following composition was prepared.

| | |
|---|---|
| Capsule solution D | 3 parts |
| Capsule solution E | 3 parts |
| Coupler dispersion | 8 parts |
| Gelatin (15% aqueous solution) | 2 parts |
| Water | 4.5 parts |

The coating solution was coated on wood free paper by a wire-bar so as to have a coating amount of the azide of 0.5 g/m$^2$ and dried at 50° C. to obtain a light- and heat-sensitive recording material of the invention.

Example 8

An inventive light- and heat-sensitive recording material was prepared in the same manner as in Example 7, except that capsule solution D was replaced by an equivalent amount of capsule solution E.

light- and heat-sensitive recording materials obtained in Examples 7 and 8 were each subjected to heating at a temperature of 90°, 100°, 110° or 120° C. for 5 sec. (0.5 kg/m$^2$), using a heat-gradient tester (produced by Toyo Seiki) and then exposed for 30 min., using a high pressure mercury lamp.

As a result, heated portions each exhibited a magenta color and densities thereof are shown as below.

| Heating Temp. | 90° C. | 100° C. | 110° C. | 120° C. |
|---|---|---|---|---|
| Example 7 | 0.22 | 0.50 | 0.73 | 1.20 |
| Example 8 | 0.49 | 1.19 | 1.21 | 1.22 |

As can be seen from the above results, density tone reproduction can be made in wider range of thermal energy by mixing two kinds of photo-color-forming elements different in color forming-initiating temperature and color forming density. This is advantageous for recording in a delicate shade of color.

Comparative Example 3

Preparation of capsule solution A

| | |
|---|---|
| Leucocrystal violet | 1 part |
| 2,2'-Bis-(o-chlorophenyl)-4,4',5,5'-tetraphenylbisimidazole | 2 parts |
| Tribromomethylphenylsulfone | 0.4 parts |
| 2,5-Di-tert-octylhydroquinone | 0.6 part |
| p-Toluenesulfonamide | 0.2 part |
| Xylylenediisocyanate/trimethylol-propane adduct (75 wt. % ethyl acetate solution) | 20 parts |

The above composition was dissolved in a mixed solvent of ethyl acetate of 16 parts and diisopropylnaphthalene of 18 parts. The solution was added to an aqueous 6% by weight solution of carboxyl-modified poly(vinyl alcohol) of 54 parts. The mixture was emulsified at 20° C. to obtain an emulsified dispersion having an average oil-drop size of 1 μm. Adding thereto water of 68 parts, the emulsion was further stirred at 40° C. for 3 hrs., returned to room temperature and filtered out to obtain capsule solution F.

| | |
|---|---|
| 3,6-Dimethoxy-9-(2-methoxycarbonyl)-phenylxanthene | 1.5 parts |
| 2,2'-Bis-(o-chlorophenyl)-4,4',5,5'-tetraphenylbisimidazole | 2 parts |
| 2,6-ditrichloromethyl-4-(p-methoxyphenyl)-triazine | 0.8 part |
| 2-(5'-methyl-2'-hydroxyphenyl)benzotriazole | 4 parts |
| Tolylenediisocyanate/trimethyolpropane adduct (75 wt. % ethyl acetate solution) | 20 parts |

The above composition was dissolved in a mixed solvent of ethyl acetate of 16 parts and diisopropylnaphthalene of 18 parts. The solution was added to an aqueous 6% by weight solution of carboxyl-modified poly(vinyl alcohol) of 54 parts. The mixture was emulsified at 20° C. to obtain an emulsified dispersion having an average oil-drop size of 1 μm. Adding thereto water of 68 parts, the emulsion was further stirred at 40° C. for 3 hrs., returned to room temperature and filtered out to obtain capsule solution G.

Preparation of reducing agent dispersion

1-Phenylpyrazolidine-3-one (Phenidone A) of 30 parts was added to 150 parts of 4% by weight aqueous solution of carboxyl-modified poly(vinyl alcohol) and the mixture was dispersed by a lateral type sand mill to obtain a Phenidone A dispersion having an average oil-drop size of 1 μm.

A coating solution of the following composition was prepared.

| | |
|---|---|
| Capsule solution F | 6.8 parts |
| Capsule solution G | 6.8 parts |
| reducing agent dispersion | 6.0 parts |
| 30% epoxy-modified polyamide resin | 0.4 part |

The coating solution was coated on wood free paper by a wire-bar so as to have a leuco dye coating amount of capsule solution G of 0.5 g/m$^2$ and dried at 50° C. to obtain a light- and heat-sensitive recording material of the invention.

Light- and heat-sensitive recording materials of Example 5 to 8 and Comparative Example 3 were allowed to stand under high temperature and high humidity (50° C. and 80% R.H.) for 3 days and then subjected to thermal printing and exposure under such a condition as to give a highest color density to make measurements with respect to a maximum density (Dm') and background density (Dmin'). The maximum density (Dm) and also background density (Dmin) of samples before being aged were so measured. Storage stability of each sample was shown in Table 2.

TABLE 2

| | Color | Deterioration of color (Dm-Dm')/(Dm-Dmin) | Stain of background (Dmin'-Dmin)/(Dm-Dmin) |
|---|---|---|---|
| Example 5 | Blue | 0.02 | 0.10 |
| | Yellow | 0.02 | 0.06 |
| Example 6 | Cyan | 0.02 | 0.09 |
| | Yellow | 0.01 | 0.05 |
| Example 7 | Magenta | 0.03 | 0.04 |
| Example 8 | Magenta | 0.03 | 0.07 |
| Comparison 3 | Blue | 0.02 | 0.35 |
| | Yellow | 0.01 | 0.23 |

As can be seen from the Table, it was proved that light- and heat-sensitive recording materials of the invention and a recoding method by use thereof were little in deterioration in color formation and stain in the background, even when allowed to stand under high temperature and high humidity.

What is claimed is:

1. A light- and heat-sensitive recording material comprising a support provided thereon a light- and heat-sensitive layer containing a photo-color-forming element comprising a photodecomposable compound and an element capable of forming a color upon reaction with a decomposition product of the photodecomposable compound, wherein said photo-color-forming element is imagewise heated so as to be mixed to thereby form a latent image and the latent image of the heated photo-color-forming element is further exposed to light to form a color; at least one of the photodecomposable compound and the element capable of forming a color being dispersed through solution in an organic solvent; wherein said photodecomposable compound is a free radical producing compound and said element capable of forming a color is a coupler and an aromatic primary amine compound, or said photodecomposable compound is an aromatic azide compound and said element capable of forming a color is a coupler.

2. The light- and heat-sensitive recording material of claim 1, wherein at least one of the photodecomposable compound and the element capable of forming a color is enclosed in microcapsules.

3. The light- and heat-sensitive recording material of claim 1, wherein said organic solvent is a high boiling solvent having a boiling point of not less than 100° C.

4. The light- and heat-sensitive recording material of claim 1, wherein the photo-color-forming element which is not heated is exposed to light so that color forming ability of the non-heated photo-color-forming element is inhibited.

5. The light- and heat-sensitive recording material of claim 1, wherein there are at least two photo-color-forming elements comprising a photodecomposable compound and an element capable of forming a color upon reaction with a decomposition product of the photodecomposable compound, and at least one of the photodecomposable compound and the element capable of forming a color are dispersed through solution in an organic solvent.

6. The light- and heat-sensitive recording material of claim 5, wherein said two photo-color-forming elements form colors different in hue with each other.

7. The light- and heat-sensitive recording material of claim 5, wherein said two photo-color-forming elements form colors different in density with each other.

8. The light- and heat-sensitive recording material of claim 5, wherein said two photo-color-forming elements each are separately contained in two different layers.

9. The light- and heat-sensitive recording material of claim 5, wherein said two photo-color-forming elements are contained together in a layer.

10. An image forming method which uses a light- and heat-sensitive recording material which comprises a support provided thereon a layer containing one or more photo-color-forming element(s), each comprising a photodecomposable compound and an element capable of forming a color upon reaction with a decomposition product of the photodecomposable compound and at least one of the photodecomposable compound and the element capable of forming a color being dispersed in an organic solvent; the method comprising the steps of heating imagewise the photo-color-forming element so as to be mixed, thereby forming a latent image and then exposing the formed latent image of the heated photo-color-forming element to light to develop the latent image, forming a color image wherein there are two photo-color-forming elements and said two photo-color-forming elements are heated to different thermal energies to form a latent image or are exposed to light at different wavelengths to form a color.

11. The image forming method of claim 10, wherein said two photo-color-forming elements which are not heated are exposed to light so that the color forming ability of the non-heated photo-color-forming elements is inhibited.

* * * * *

UNITED STATES PATENT AND TRADEMARK OFFICE
CERTIFICATE OF CORRECTION

PATENT NO. : 5,789,135
DATED : Aug. 4, 1998
INVENTOR(S) : N. Goto, et al

It is certified that error appears in the above-identified patent and that said Letters Patent is hereby corrected as shown below:

Title page, item [30] cancel "Dec. 4, 1919"
insert -- Dec. 4, 1995 --

Signed and Sealed this

Seventeenth Day of November, 1998

*Attest:*

*Attesting Officer*

Bruce Lehman

BRUCE LEHMAN

*Commissioner of Patents and Trademarks*